US011649625B2

(12) United States Patent
Qu

(10) Patent No.: US 11,649,625 B2
(45) Date of Patent: May 16, 2023

(54) BEAM-COLUMN JOINT STRUCTURE OF PREFABRICATED STEEL STRUCTURE BUILDING

(71) Applicant: Guocai(Beijing) Academy of Building Science Co., Ltd., Beijing (CN)

(72) Inventor: Jiaosheng Qu, Beijing (CN)

(73) Assignee: GUOCAI (BEIJING) ACADEMY OF BUILDING SCIENCE CO., LTD., Beijing (CN)

( * ) Notice: Subject to any disclaimer, the term of this patent is extended or adjusted under 35 U.S.C. 154(b) by 0 days.

(21) Appl. No.: 17/347,122

(22) Filed: Jun. 14, 2021

(65) Prior Publication Data

US 2021/0395996 A1 Dec. 23, 2021

(30) Foreign Application Priority Data

Jun. 17, 2020 (CN) ..... 202021129534.1

(51) Int. Cl.
*E04B 1/24* (2006.01)

(52) U.S. Cl.
CPC .... *E04B 1/2403* (2013.01); *E04B 2001/2406* (2013.01); *E04B 2001/2421* (2013.01); *E04B 2001/2451* (2013.01)

(58) Field of Classification Search
CPC ..... E04B 2001/2406; E04B 2001/2421; E04B 2001/2451; E04B 2001/2415; E04B 2001/2448; E04B 2001/2457; F16B 7/046; F16B 7/0453
See application file for complete search history.

(56) References Cited

U.S. PATENT DOCUMENTS 3,960,275 A * 6/1976 Haughton ..... A47F 5/13 403/194
4,150,907 A * 4/1979 Thurnauer ..... F16B 12/40 403/191
4,264,230 A * 4/1981 Vanderminden ..... F16B 7/0446 403/182

(Continued)

FOREIGN PATENT DOCUMENTS

CN 206090823 U * 4/2017
CN 206090823 U 4/2017

(Continued)

OTHER PUBLICATIONS

Notice of Correction from CN app. No. 202021129534.1, dated Dec. 8, 2020, with machine English translation from Google Translate.

(Continued)

*Primary Examiner* — Brian E Glessner
*Assistant Examiner* — Adam G Barlow
(74) *Attorney, Agent, or Firm* — Ladas & Parry, LLP

(57) ABSTRACT

A beam-column node structure of the steel prefabricated building is provided. The structure includes inner sleeves and driving components. The inner sleeves are slidably embedded in the transverse sleeves of the cross beam or node member; the driving components are used to drive the inner sleeves to move from one of the cross beams and the transverse sleeves embedded with the inner sleeves to the other. The inner sleeves are partly located in the crossbeams and partly in the lateral sleeves, and then the internal connection between the crossbeams and the lateral sleeves can be realized by the fasteners.

10 Claims, 14 Drawing Sheets

(56) References Cited

U.S. PATENT DOCUMENTS 5,188,479 A * 2/1993 Nehls ..... F16B 19/1081 403/306
5,289,665 A * 3/1994 Higgins ..... E04B 5/43 52/655.1
5,535,555 A * 7/1996 Boyd ..... E01F 9/635 248/548
5,556,218 A 9/1996 Homer
5,921,049 A * 7/1999 Sugiyama ..... F16B 9/058 52/656.1
7,037,030 B2 * 5/2006 McLemore ..... E01F 13/048 404/6
8,161,690 B1 * 4/2012 Borne ..... E04B 5/12 52/480
8,297,023 B2 * 10/2012 Collins ..... E04B 1/24 52/704
8,950,147 B2 * 2/2015 Dao ..... E04F 15/02 52/309.3
2003/0084523 A1 * 5/2003 Szekely ..... E01C 11/24 14/69.5
2008/0053020 A1 * 3/2008 Collins ..... E04B 1/24 52/282.4
2010/0071305 A1 * 3/2010 Collins ..... E04B 1/24 52/704
2017/0233996 A1 * 8/2017 Abernathy ..... F16B 7/182 52/698
2019/0376273 A1 * 12/2019 Mou ..... E04H 9/024
2020/0378106 A1 * 12/2020 Post ..... E04B 1/2403
2021/0140168 A1 * 5/2021 Adams ..... E04B 1/40
2021/0207358 A1 * 7/2021 Jin ..... E04H 9/024
2022/0042296 A1 * 2/2022 Dai ..... E04G 17/14

FOREIGN PATENT DOCUMENTS

CN 206844313 U 1/2018
CN 207314534 U * 5/2018

OTHER PUBLICATIONS

Office action from New Zealand Patent Application No. 769291 dated Jul. 13, 2022.

* cited by examiner

BEAM-COLUMN JOINT STRUCTURE OF PREFABRICATED STEEL STRUCTURE BUILDING

CROSS-REFERENCE TO RELATED APPLICATION

The application claims priority to Chinese Patent Application No. 202021129534.1 filed on Jun. 17, 2020, the disclosure of which is incorporated herein by reference in its entirety.

TECHNICAL FIELD

The disclosure relates to the technical field of steel prefabricated building, in particular to a beam-column joint structure of steel prefabricated building.

TECHNICAL BACKGROUND

Prefabricated buildings are the representatives of modern industrial production methods because they adopt standardized design, factory production, assembly construction, information management, and intelligent application.

Steel-structured prefabricated buildings have inherent advantages. The fundamental factor in the development of prefabricated buildings is cost. Because square tube beams have good structural stability, they are suitable for low-rise (less than three stories) buildings. The combination of square tube beam-columns and embedded walls can make the whole building have better wind resistance and seismic performance, and reduce the construction cost of support system. However, the existing square tube beam-column connection nodes require a lot of on-site welding work, and the installation of the connection lining plates between the crossbeams and the lateral sleeves requires destruction and then reparation of the crossbeams. The installation process is complicated and the operation is difficult.

In summary, how to solve the problem of complicated installation process and difficult operation of the beam-column connection node of the steel prefabricated building has become a technical problem urgently needed to be solved by those skilled in the art.

SUMMARY OF THE DISCLOSURE

The purpose of the present disclosure is to provide a beam-column node structure of the steel prefabricated building, to solve the problems of complicated installation process and difficult operation of the beam-column connection node of the steel prefabricated building.

In order to achieve the above objects, the present disclosure provides a beam-column node structure of a steel prefabricated building, which includes inner sleeves and driving components;

The inner sleeves are slidably embedded in the transverse sleeves of the cross beams or node members;

The driving components are used for driving the inner bush to move from one of the beams and the transverse sleeves embedded with the inner sleeves to the other.

Preferably, the driving components include rack grooves and driving rods, the rack grooves are arranged on the inner sleeves and along the axial direction of the inner sleeves; the ends of the driving rods are provided with a gear which matches the rack grooves, and the cross beams and the lateral sleeves are provided with a hole for the driving rods to pass through.

Preferably, the top ends of the driving rods are provided with tool connectors, which are used for directly connecting with the driving tools.

Preferably, the rack grooves comprise the through grooves arranged on the wall surface of the inner sleeves, the racks arranged on the inner side of the inner sleeves and on one side facing the through grooves, the supporting plates arranged on the inner side of the inner sleeves and facing the position of the through groove, and the limited plates arranged on the inner side of the inner sleeves and on the side opposite to the rack; the supporting plates are used to support the gears, and the limited plates are used for preventing the gears from moving laterally.

Preferably, the driving components comprise vertical sleeves which penetrate the node members transversely and pull rods of the inter-layer columns, the inner sleeves are slidably arranged in the cross beams, and the through ends of the pull rods are provided with coupling parts for hanging with the inner sleeves.

Preferably, the inner sleeves include a rectangular lining pipe surrounded by an upper lining plate, a lower lining plate, a front lining plate, and a rear lining plate, and a flexible end plate at both ends of the rectangular lining plate; the upper lining plate, the lower lining plate, the front lining plate, and the back lining plate have preset splicing gaps between any two adjacent lining plates; the upper end of the flexible end plate is connected with the upper lining plate; the lower end of the flexible end plate is connected with the lower lining plate; the front end of the flexible end plate is connected with the front lining plate; the rear end of the flexible end plate is connected with the rear lining plate.

Preferably, the upper end of the flexible end plate is provided with an upper flexible connection bit connected with the upper lining plate; the lower end of the flexible end plate is provided with a lower flexible connection bit connected with the lower lining plate; the front end of the flexible end plate is provided with a front flexible connection bit connected with the front lining plate; the rear end of the flexible end plate is provided with a rear flexible connection bit connected with the rear lining plate.

Preferably, the interface of the transverse sleeve is a first step opening with a notch at the upper part, and the cross beams are provided with a second step opening with a notch at the lower part which is matched with the first step opening.

Preferably, the top end of the vertical sleeve of the node member is connected with the upper column through a flange, and the bottom end of the vertical sleeve is embedded in the lower column, and the outer side of the vertical sleeve is also provided with a limited supporting plate which is opposite to the end surface of the lower column; or, the bottom end of the vertical sleeve is sheathed in the lower column, and the outer side of the lower column is also provided with a limited supporting plate which is opposite to the end face of the vertical sleeve.

Preferably, the node member is provided with a mounting hole, with inner thread formed by hot melting or rolling on the inner sleeve, for installing the fastener.

Compared with the existing connection nodes introduced in Technical background, the beam-column joint structure of the steel prefabricated building includes inner sleeves and driving components; the inner sleeves are slidably embedded in the transverse sleeves of the cross beams or the node components; the driving components are used to drive the inner sleeves to move from one of the inner sleeves embedded in the cross beams and the transverse sleeves to the other. In the practical application of the beam-column joint structure of the steel prefabricated building, because the inner sleeves can be slidably embedded in the crossbeams or the transverse sleeves, the inner sleeves can be driven to move axially from the one with the inner sleeves embedded in the crossbeams or the transverse sleeves to the other by controlling the driving components. Finally, the inner sleeves are partially located in the crossbeams, partially in the transverse sleeves, and then the internal connection between the crossbeams and the transverse sleeves can be realized by the fasteners. The installation process is simple and the operation difficulty is greatly reduced.

Figure 1:
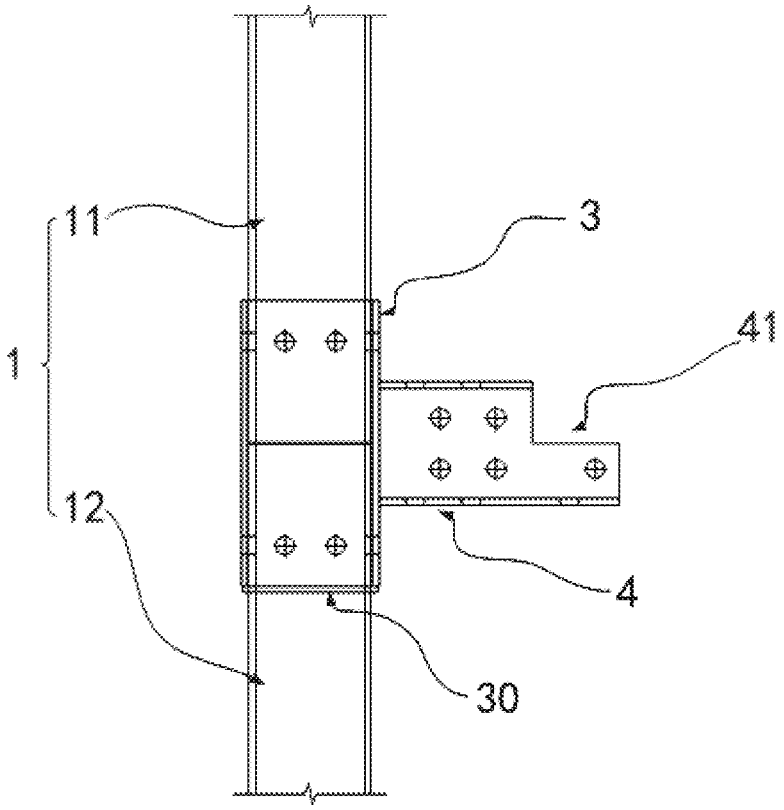
FIG. 1 is a perspective structure diagram of the connection between the node member and the inter-layer column provided by the embodiment of the disclosure.
Figure 2:
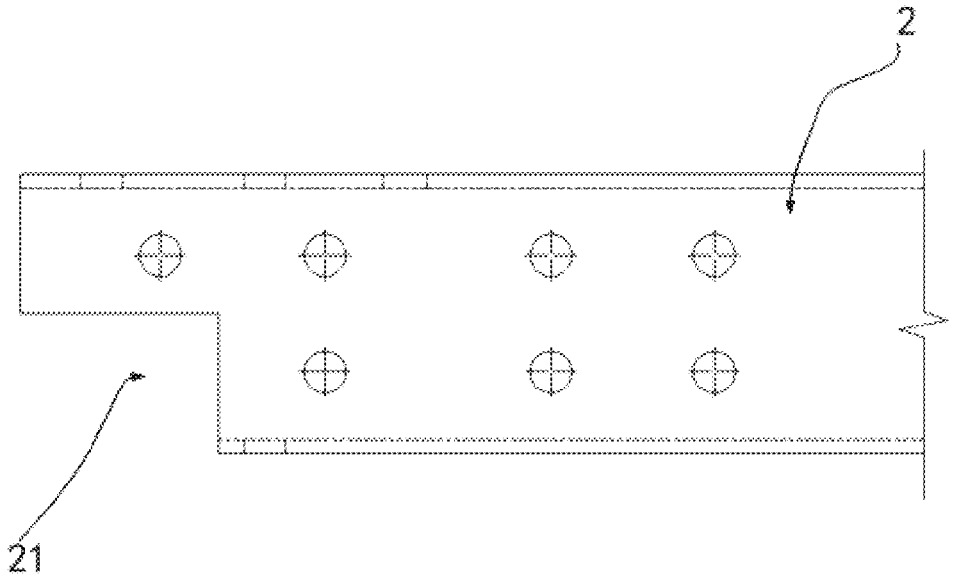
FIG. 2 is a structural diagram of the second step opening arranged on the crossbeam provided by an embodiment of the disclosure.
Figure 3:
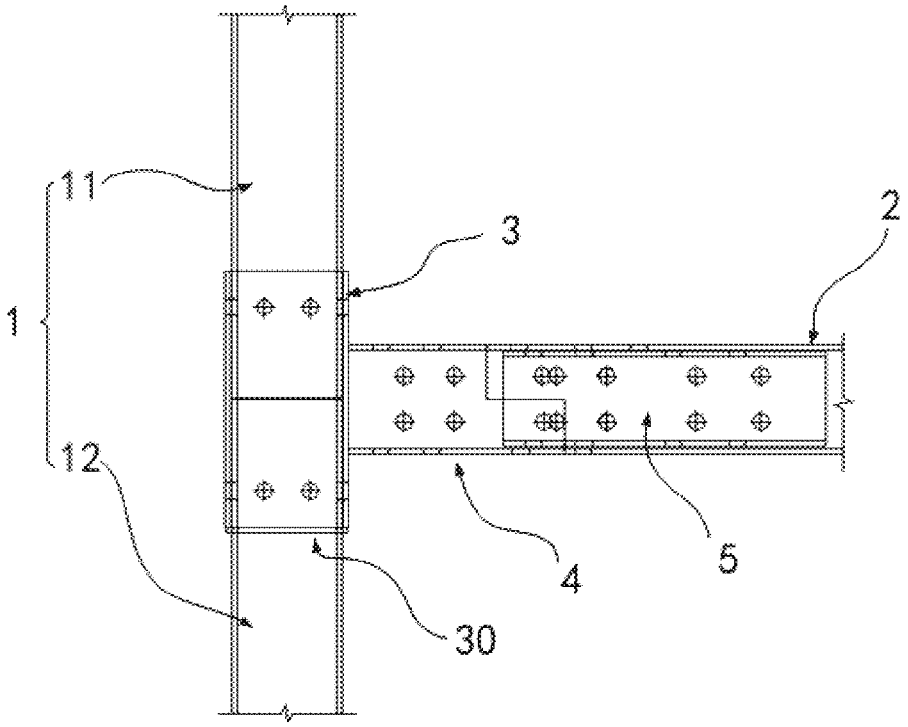
FIG. 3 is a perspective structure diagram before the inner sleeve moves axially when the transverse sleeve of the node member is butted with the cross beam provided by the embodiment of the disclosure.
Figure 4:
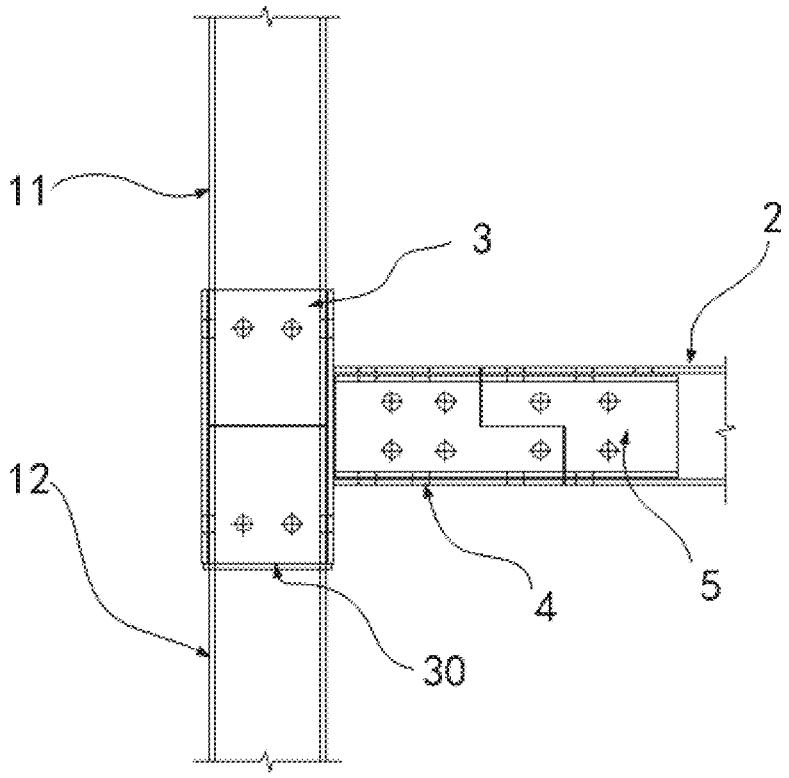
FIG. 4 is a perspective structure diagram of the inner sleeve axially moves in place when the transverse sleeve of the node member connects with the cross beam provided by the embodiment of the disclosure.
Figure 5:
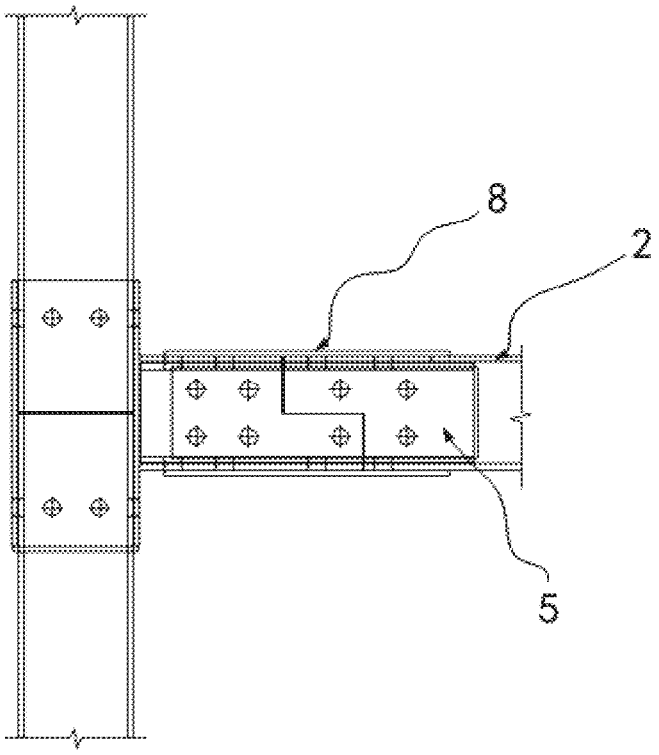
FIG. 5 is a perspective structure diagram of a connecting splint arranged at the connection bit of the transverse sleeve and the cross beam of the node member provided by the embodiment of the disclosure.
Figure 6:
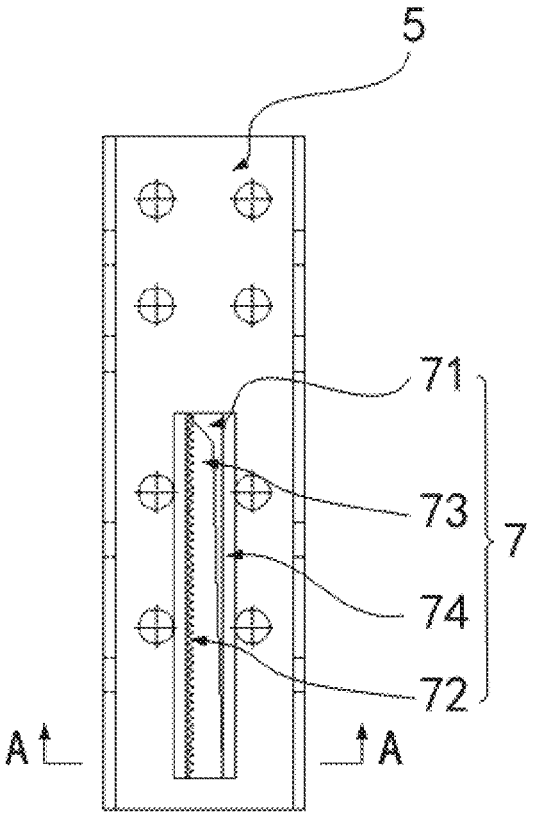
FIG. 6 is a structural diagram of the flexible inner sleeve provided by the embodiment of the disclosure.
Figure 7:
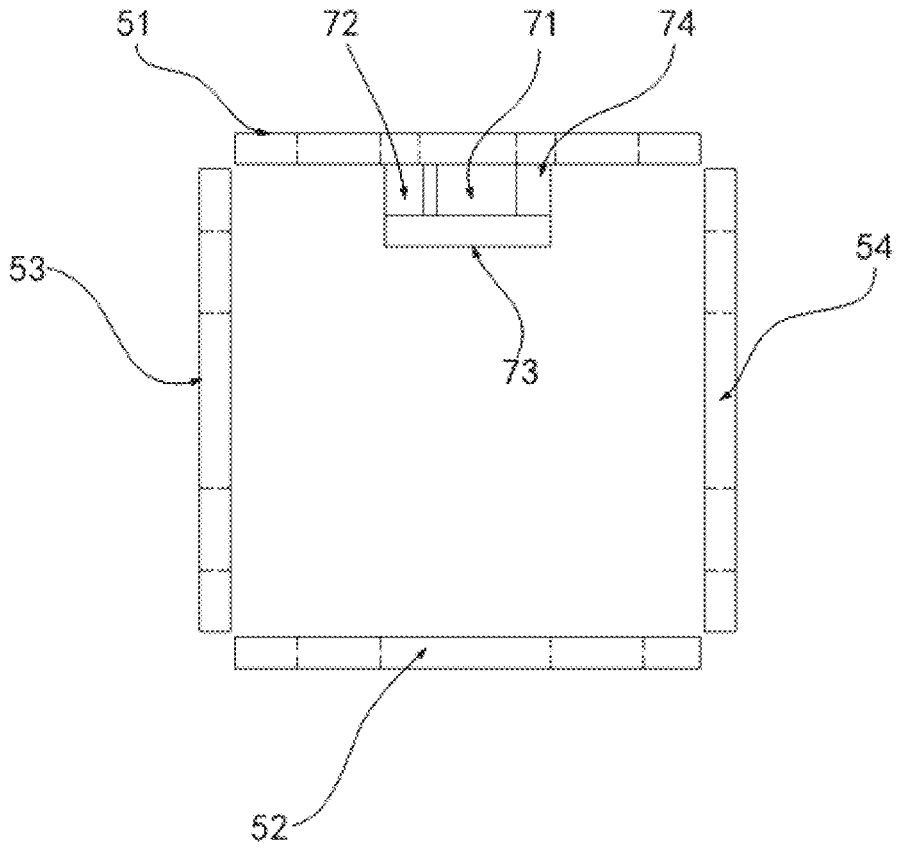
FIG. 7 is the A-A section structure diagram of FIG. 6.
Figure 8:
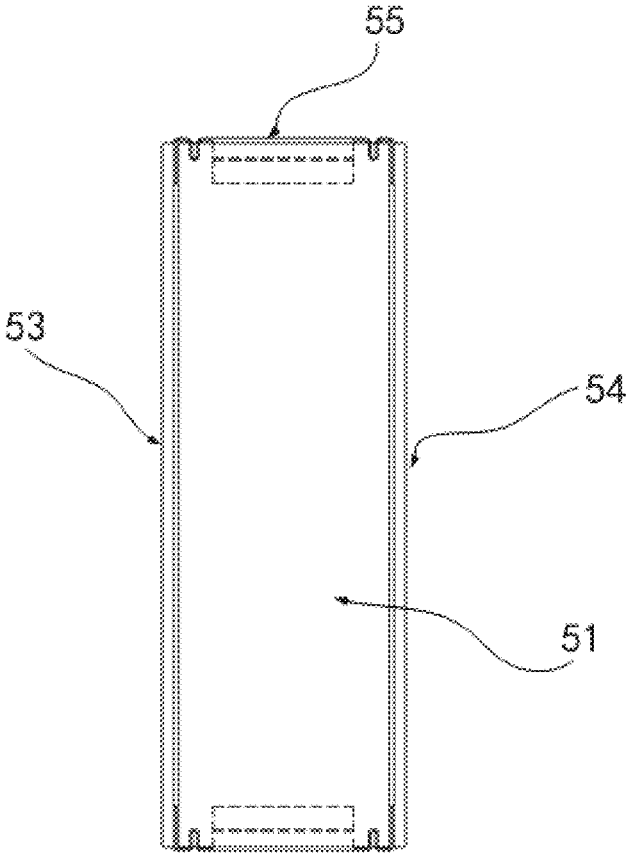
FIG. 8 is a structural diagram of a flexible end plate arranged at both ends of a flexible inner sleeve provided by an embodiment of the disclosure.
Figure 9:
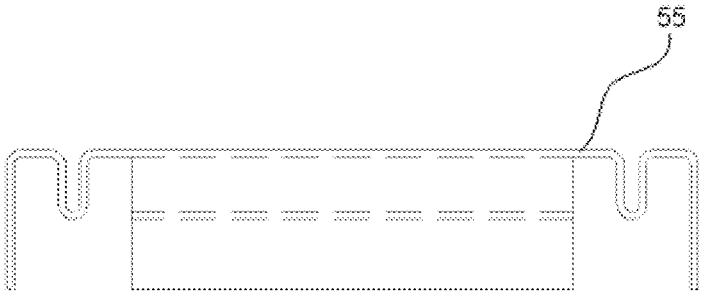
FIG. 9 is a structural diagram of the flexible end plate provided by the embodiment of the disclosure.
Figure 10:
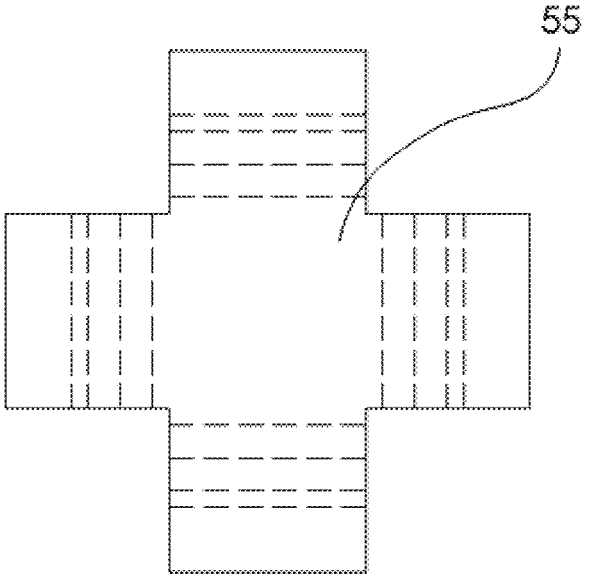
FIG. 10 is a schematic diagram of the expanded structure of the flexible end plate provided by the embodiment of the disclosure.
Figure 11:
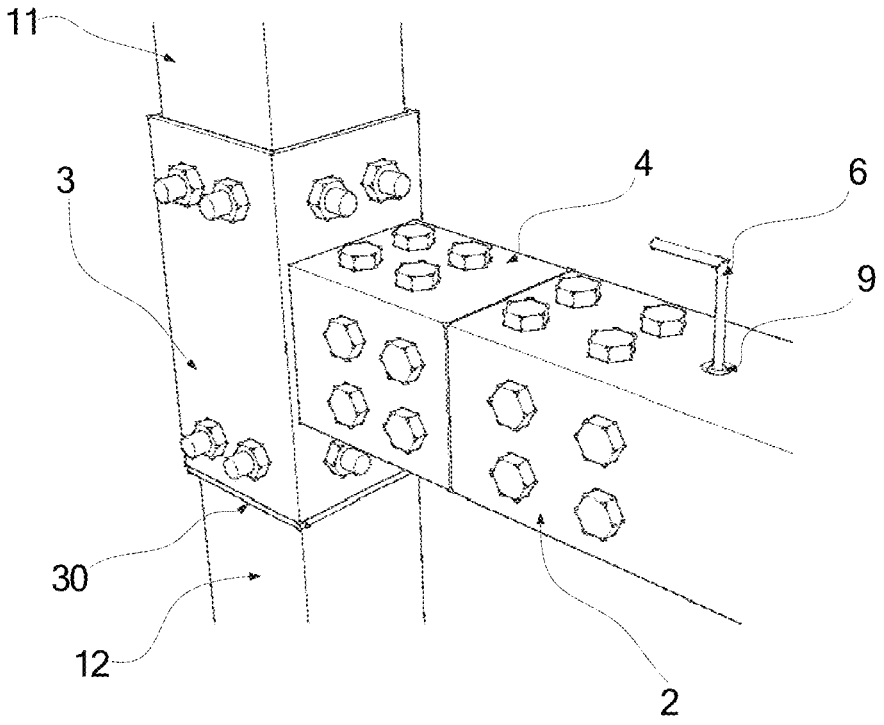
FIG. 11 is a schematic view of the external structure of the beam-column node structure of the steel prefabricated building provided by an embodiment of the present disclosure when the installation is completed.
Figure 12:
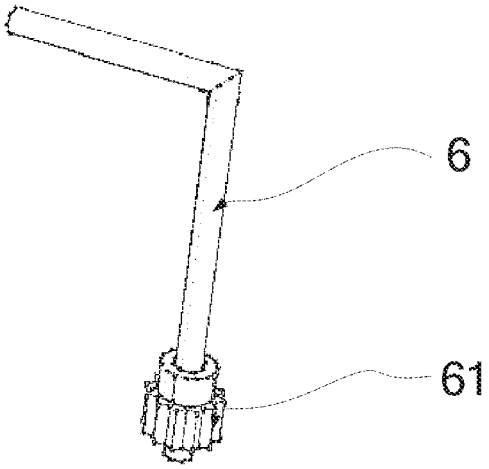
FIG. 12 is a structural diagram of the driving rod provided in the embodiment of the disclosure.
Figure 13:
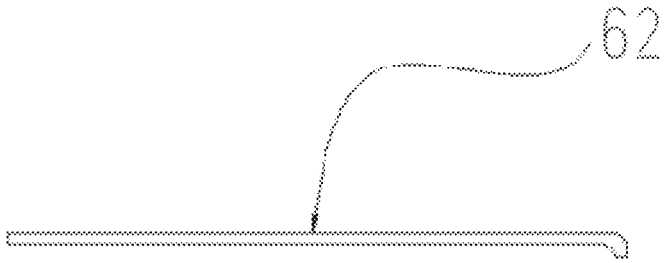
FIG. 13 is a structural diagram of the pull rod provided in the embodiment of the disclosure.
Figure 14:
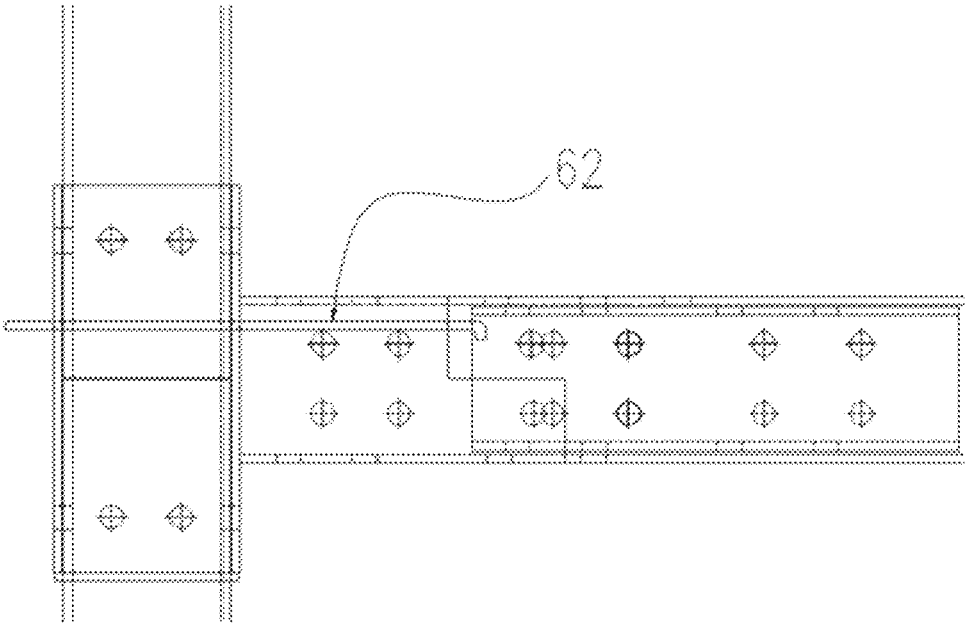
FIG. 14 is a structural diagram of the inner sleeve of the pull rod driving provided by the embodiment of the present disclosure.

From FIG. 1 to FIG. 14,

Inter-layer column 1, upper column 11, lower column 12, cross beam 2, second step opening 21, vertical sleeve 3, limited bracket 30, transverse sleeve 4, first step opening 41, inner sleeve 5, upper lining plate 51, lower lining plate 52, front lining plate 53, rear lining plate 54, flexible end plate 55, driving rod 6, gear 61, pull rod 62, rack slot 7, through slot 71, rack 72, supporting plate 73, limited plate 74, connecting clamp plate 8, through hole 9.

DETAILED DESCRIPTION

The core of the present disclosure is to provide a beam-column node structure of the steel prefabricated building to solve the problems of complicated installation process and difficult operation of the beam-column connection node of the steel prefabricated building.

For those skilled in the art to better understand the technical solutions provided by the present disclosure, it will be further described in detail below with reference to the accompanying drawings and specific embodiments.

As shown in FIG. 1-14, the embodiment of the disclosure provides an inner sleeve 5 and driving components; the inner sleeve 5 is slidably embedded in the transverse sleeve 4 of the crossbeams 2 or the node member; the driving components are used to drive the inner sleeve 5 to move from one of the crossbeams 2 and the transverse sleeve 4 embedded with the inner sleeve 5 to the other.

In the practical application of the beam-column joint structure of the steel prefabricated building, because the inner sleeves can be slidably embedded in the crossbeams or the transverse sleeves, the inner sleeves can be driven to move axially from the one with the inner sleeves embedded in the crossbeams or the transverse sleeves to the other by controlling the driving components. Finally, the inner sleeves are partially located in the crossbeams, partially in the transverse sleeves, and then the internal connection between the crossbeams and the transverse sleeves can be realized by the fasteners. The installation process is simple and the operation difficulty is greatly reduced.

It needs to be noted that those skilled in the art will be able to understand that, for the beam-column node structure, it generally includes the node members for connecting the inter-layer column 1 and the cross beam 2, the node members include the vertical sleeve 3 and the lateral sleeve 4 fixed horizontally outside the vertical sleeve 3, wherein the top end of the vertical sleeve 3 is used for connecting with the upper column 11, and the bottom end of the vertical sleeve 3 is used for connecting with the lower column 12. In the process of practical application, the top and bottom of the vertical sleeves are connected to the upper columns and the lower columns respectively, which realizes the connection of the columns between the layers, and is connected with the cross beams through the horizontal sleeves.

In some specific embodiments, the specific structure of the driving components may include a rack groove 7 and a drive rod 6, wherein the rack groove 7 is arranged on the inner sleeve 5 and along the axial direction of the inner sleeve 5; the end of the driving rod 6 is provided with a gear 61 matched with the rack groove 7, and a through hole 9 for the driving rod 6 to pass through is arranged on one of the crossbeams 2 and the transverse sleeve 4 embedded with the inner sleeve 5. In the practical application process, when the driving rod rotates, it can drive the gear, which will drive the rack grooves to move axially, and then it can make the inner sleeves move from one of the inner sleeves embedded in the crossbeams or the transverse sleeves to the other. The inner sleeves are partially located in the crossbeams and partially in the transverse sleeves, which realizes the internal connection of the crossbeams and the transverse sleeves. When the installation is completed and the inner sleeve reaches at a desired location, fasteners can be used to fasten and reinforce these parts through a plurality of mounting holes.

In the further embodiment, the top end of the driving rod 6 can also be provided with a tool connector, which can be directly connected with the driving tool, for example, the tool connectors can be designed to match the structure of the electric drill chuck, can realize the rotation of the driving rod through the electric drill, can also be designed to match the electric wrench connectors, so it can be directly driven by an electric wrench. Of course, it can also be designed as a bending handle to realize the rotation of a driving rod by manually moving it. In the actual application process, it can be selected according to the actual needs.

In the further embodiment, the specific structure of the rack slot 7 includes a through slot 71 arranged on the wall surface of the inner sleeve 5 and a rack 72 arranged on the inner side of the inner sleeve 5 and facing one side of the through slot 71. The rack can be fixed on the inner sleeves by welding, or other fixing methods commonly used by those skilled in the art, such as bolt fastening method, etc.

In the further embodiment, the specific structure of the rack slot 7 can also include the supporting plate 73 arranged on the inner side of the inner sleeve 5 and facing the position of the through slot 71, and the supporting plate 73 is used to support gear 61. By setting the supporting plate 73, the longitudinal direction of the gear can be limited so that the gear is always flush with the rack.

In the further embodiment, the rack slot 7 can also include a limited plate 74 arranged on the inner side of the inner sleeve 5 and on the side opposite to the rack 72, which is used to prevent the lateral movement of the gear 61. The gears that can be tested by arranging the limited plate always keep the meshing state with the rack, so that the driving rod can be driven more effectively.

In addition, it should be noted that the above-mentioned method of driving rack grooves with driving rods and gears is only a preferred example of the embodiment of the disclosure. In the practical application process, other driving methods can also be adopted. For example, the driving components can specifically include the vertical sleeve 3 of the transverse through the joint member and the pull rod 62 of the inter-layer column 1, and the inner sleeve 5 can be slidably arranged in the crossbeams 2. The through end of the pull rod 62 is provided with a coupling part for the inner sleeve 5. By pulling the pull rod 62, the inner sleeves move from the crossbeams to the transverse sleeves, and finally the inner sleeves are partially located in the transverse sleeves and partially in the crossbeams, so as to realize the internal connection between the crossbeams and the transverse sleeves. It needs to be noted that the structure of the above hanging parts can be a hook or a snap structure, or other hanging structures commonly used by those skilled in the art. No specific limitation is made here.

In addition, it should be noted that the structure of the inner sleeves can be designed as a rigid structure or a flexible structure. Generally speaking, in order to reduce the fit clearance between the inner sleeves and the cross beams and the transverse sleeves more effectively, the structure of the inner sleeves is preferably designed as a flexible structure with certain deformation ability. Through the flexible structure, when the inner sleeves fit with the cross beams and the inner sides of the transverse sleeves, it more closely and effectively improves the connection stability of the inner sleeves. However, in order to move conveniently, the traditional inner sleeves, crossbeams, and splints usually need to reserve a gap of about 1 mm, which results in low stability after prefabrication.

The specific structure of the inner sleeves of the flexible structure can include a rectangular lining pipe surrounded by an upper lining plate 51, a lower lining plate 52, a front lining plate 53 and a rear lining plate 54, and a flexible end plate 55 at both ends of the rectangular lining pipe; there is a preset splicing gap between any two adjacent lining plates in the upper lining plate 51, the lower lining plate 52, the front lining plate 53 and the rear lining plate 54; the upper end of the flexible end plate 55 is connected to the upper lining plate 51; the lower end of the flexible end plate 55 is connected to the lower lining plate 52; the front end of the flexible end plate 55 is connected to the front lining plate 53; the rear end of the flexible end plate 55 is connected to the rear lining plate 54. As the end plate connecting the upper, lower, front and rear lining plates is flexible end plate, when the inner sleeves are fitted into the crossbeams or transverse sleeves, the deformation of the flexible end plates can make the overall rectangular liner structure shrink, and then tight fit with the inner side of the crossbeams or transverse sleeves is realized.

It should be noted that the specific structural form of the flexible end plate 55 can be that the upper end of the flexible end plate 55 is provided with an upper flexible connection bit connected with the upper lining plate 51, the lower end of the flexible end plate 55 is provided with a lower flexible connection bit connected with the lower lining plate 52, the front end of the flexible end plate 55 is provided with a front flexible connection bit connected with the front lining plate 53, and the rear end of the flexible end plate 55 is provided with a connection bit connected with the rear lining plate 54. The upper flexible connection position, the lower flexible connection position, the front flexible connection position, and the rear flexible connection position are all shrapnel structures integrated with the flexible end plate 55, such as the structural form of folding U shape by the thin steel plate. Of course, it can be understood that the spring structure is only an example of the flexible connection bit in the embodiment of the disclosure. In the practical application process, other structures of the flexible connection bit commonly used by those skilled in the art, such as spring or elastic rubber, can also be used. In addition, the flexible connection mode of the flexible end plate is also a preferred example of the embodiment of the disclosure. In the actual application process, it can also be an overall elastic end plate structure, such as rubber block, etc.

In some more specific embodiments, in order to facilitate the butt positioning of the transverse sleeve 4 and the crossbeams, the butt joint of the transverse sleeve 4 can be designed as a first step opening 41 with a gap at the upper part, and a second step opening 21 with a gap at the lower part which is suitable for the first step opening 41 is arranged on the crossbeams 2. By matching the first step opening with the second step opening, it is convenient for the butt positioning between the transverse sleeves and the cross beams, and the first step opening can also share the longitudinal shear force of the inner sleeves. Of course, it can be understood that the matching form of the first step opening and the second step opening in the above design is only the preferred distance of the embodiment of the disclosure. In the actual application process, other gap forms can be selected according to the convenience of actual processing and installation requirements, and no more specific restrictions are made here.

In the further implementation scheme, in order to ensure the stability of the connection between the transverse sleeve 4 and the cross beam 2, generally, a connecting clamp plate 8 is arranged outside the butt joint position of the transverse sleeve 4 and the cross beam 2. The connecting splint can be fixed directly by fastening, and the connection is very convenient. It should be noted that the specific structural form of the connecting splint can be the splint structure arranged relative to the upper and lower positions of the crossbeams, or the splint structure arranged relative to the left and right positions of the crossbeams, and the structural form of the connecting splint can adopt the U-shaped plate, which can be clamped and fixed by the way of splicing. In the process of practical application, the layout can be selected according to the actual needs without more specific restrictions.

It should be noted that in general, the top end of the vertical sleeve 3 of the joint member can be connected with the upper column 11 through the flange, which makes the operation easier and more convenient. Of course, it can be understood that the above method of flange connection is only a preferred example of the embodiment of the disclosure. In the actual application process, it can also be done through other butt connection methods.

In the further embodiment, the bottom end of the vertical sleeve 3 can be embedded in the lower column 12, and the outer side of the vertical sleeve 3 is also provided with a limited supporting plate 30, which is opposite to the end face of the lower column 12; of course, the bottom end of the vertical sleeve 3 is sheathed in the lower column 12, and the outer side of the lower column 12 is also provided with a limited supporting plate 30 which is against the end face of the vertical sleeve 3. Through the structural form of the limited plates, the shear force of the fastener connected between the vertical sleeves and the lower columns can be shared by the limited plates. In the same way, the connection structure between the top of the vertical sleeve 3 and the upper column 11 can also adopt the similar connection form of the limited plates, which will not be discussed here.

In addition, it should be noted that in general, the connection between the node components and the inter-layer columns and crossbeams is usually made by fasteners, such as lengthening bolts. Therefore, the corresponding node members generally need to be provided with a mounting hole for installing fasteners. The inner thread mounting hole is formed by hot melting or rolling. It can enhance the clamping force to a certain extent and reduce the shear force on the fastener.

The beam-column joint structure of the steel prefabricated building provided by the disclosure is described in detail above. It should be noted that each embodiment in the specification is described in a progressive way, and each embodiment focuses on the differences from other embodiments. The same and similar parts of each embodiment can be used as reference for each other.

It should also be noted that in this paper, the terms "including", "contain" or any other variation thereof are intended to cover nonexclusive inclusion so that articles or equipment including a series of elements contain not only those elements, but also other elements not explicitly listed, or elements inherent in such articles or equipment. Without further restrictions, the statement "include . . . " does not exclude the existence of other identical elements in the articles or equipment containing the above elements.

In this paper, specific examples are applied to explain the principle and implementation mode of the disclosure. The above examples are only used to help understand the core idea of the disclosure. It should be noted that for those skilled in the art, without departing from the principles of the disclosure, several improvements and modifications can be made to the disclosure, which also fall within the scope of protection of the claims of the disclosure.

What is claimed is:

1. A beam-column node structure of a steel prefabricated building, comprising by an inner sleeve and a plurality of driving components, wherein the plurality of driving components comprise a rack groove and a driving rod;

wherein the inner sleeve is configured to be slidably embedded in a cross beam or a transverse sleeve of a node member; and the plurality of driving components are configured to drive the inner sleeve to move from one of the cross beam or the transverse sleeve embedding the inner sleeve to the other;

wherein the rack groove is provided on the inner sleeve and arranged along an axial direction of the inner sleeve; an end of the driving rod is provided with a gear cooperating with the rack groove, and a hole for the driving rod to pass through is arranged on one of the cross beam or the transverse sleeve embedding the inner sleeve.

2. The beam-column node structure according to claim 1, wherein a top end of the driving rod is provided with a tool connector configured to directly connect with a driving stool, wherein the tool connector is a gear.

3. The beam-column node structure according to claim 1, wherein the rack groove comprises a through groove on a wall surface of the inner sleeve, a rack disposed on an inner side of the inner sleeve, and facing one side of the through groove, a supporting plate arranged on the inner side of the inner sleeve, and facing the through groove; and a limited plate arranged on the inner side of the inner sleeve and the side opposite to the rack; the supporting plate is configured to support the gear; the limited plate is configured to prevent the gear from moving laterally.

4. The beam-column node structure according to claim 1, wherein the plurality of driving components comprise a vertical sleeve transversely penetrating the node member and a tie rod of an inter-layer column; wherein the inner sleeve is slidably arranged in the cross beam, and a through end of the tie rod is provided with a coupling part configured to couple with the inner sleeve.

5. The beam-column node structure according to claim 1, wherein the inner sleeve comprises a rectangular liner structure surrounded by an upper lining plate, a lower lining plate, a front lining plate and a rear lining plate and a flexible end plate at both ends of the rectangular liner structure; wherein there is a preset splicing gap between any two adjacent lining plates of the upper lining plate, the lower lining plate, the front lining plate and the rear lining plate; an upper end of the flexible end plate is configured to connect with the upper lining plate; a lower end of the flexible end plate is configured to connect with the lower lining plate; a front end of the flexible end plate is configured to connect with the front lining plate, and a rear end of the flexible end plate is configured to connect with the rear lining plate.

6. The beam-column node structure according to claim 5, wherein the upper end of the flexible end plate is provided with an upper flexible connection bit connected with the upper lining plate; the lower end of the flexible end plate is provided with a lower flexible connection bit connected with the lower lining plate; the front end of the flexible end plate is provided with a front flexible connection bit connected with the front lining plate; and the rear end of the flexible end plate is provided with a rear flexible connection bit connected with the rear lining plate.

7. The beam-column node structure as in claim 1, wherein the node member is provided with a mounting hole for installing a fastener, and the mounting hole comprises an inner thread formed by hot melting or rolling on the inner sleeve.

8. The beam-column node structure according to claim 2, wherein the inner sleeve comprises a rectangular liner structure surrounded by an upper lining plate, a lower lining plate, a front lining plate and a rear lining plate and a flexible end plate at both ends of the rectangular liner structure;

wherein there is a preset splicing gap between any two adjacent lining plates of the upper lining plate, the lower lining plate, the front lining plate and the rear lining plate; an upper end of the flexible end plate is configured to connect with the upper lining plate; a lower end of the flexible end plate is configured to connect with the lower lining plate; a front end of the flexible end plate is configured to connect with the front lining plate, and a rear end of the flexible end plate is configured to connect connected with the rear lining plate.

9. The beam-column node structure according to claim 3, wherein the inner sleeve comprises a rectangular liner structure surrounded by an upper lining plate, a lower lining plate, a front lining plate and a rear lining plate and a flexible end plate at both ends of the rectangular liner structure; wherein there is a preset splicing gap between any two adjacent lining plates of the upper lining plate, the lower lining plate, the front lining plate and the rear lining plate; an upper end of the flexible end plate is configured to connect with the upper lining plate; a lower end of the flexible end plate is configured to connect with the lower lining plate; a front end of the flexible end plate is configured to connect with the front lining plate, and a rear end of the flexible end plate is configured to connect with the rear lining plate.

10. The beam-column node structure according to claim 4, wherein the inner sleeve comprises a rectangular liner structure surrounded by an upper lining plate, a lower lining plate, a front lining plate and a rear lining plate and a flexible end plate at both ends of the rectangular liner structure; wherein there is a preset splicing gap between any two adjacent lining plates of the upper lining plate, the lower lining plate, the front lining plate and the rear lining plate; an upper end of the flexible end plate is configured to connect with the upper lining plate; a lower end of the flexible end plate is configured to connect with the lower lining plate; a front end of the flexible end plate is configured to connect with the front lining plate, and a rear end of the flexible end plate is configured to connect with the rear lining plate.

* * * * *